United States Patent [19]

Foulke et al.

[11] 3,990,954

[45] Nov. 9, 1976

[54] SULFITE GOLD PLATING BATH AND PROCESS

[75] Inventors: Donald G. Foulke, Plainfield; John M. Deuber, Nutley, both of N.J.

[73] Assignee: Oxy Metal Industries Corporation, Warren, Mich.

[22] Filed: Dec. 17, 1973

[21] Appl. No.: 425,485

[52] U.S. Cl. ..... 204/46 G; 204/43 G; 204/44

[51] Int. Cl.[2] ..... C25D 3/48; C25D 3/62

[58] Field of Search ..... 204/43 G, 44, 46 G; 106/1; 117/130 E

[56] References Cited

UNITED STATES PATENTS

| | | | |
|---|---|---|---|
| 3,057,789 | 10/1962 | Smith | 204/46 G |
| 3,475,292 | 10/1969 | Shoushanian | 204/44 |
| 3,666,640 | 5/1972 | Smith | 204/44 |
| 3,672,969 | 6/1972 | Nobel et al. | 204/43 G |
| 3,770,596 | 11/1973 | Bick et al. | 204/43 G |
| 3,776,822 | 12/1973 | Baker | 204/46 G |
| 3,883,409 | 5/1975 | Olivier | 204/44 |

*Primary Examiner*—G. L. Kaplan

*Attorney, Agent, or Firm*—Arthur E. Kluegel; Richard P. Mueller; Bertram F. Claeboe

[57] ABSTRACT

Disclosed is an improved electroplating bath and process for obtaining semi-bright to bright electrodeposits of gold and gold alloys. The electroplating bath contains a gold sulfite complex and a nitrogen-free diphosphonic compound having at least two phosphonic groups attached directly to a carbon atom. Presence of the nitrogen-free phosphonate compound enhances the stability of the gold sulfite baths and improves the brightness of electrodeposits obtained therefrom.

5 Claims, No Drawings

SULFITE GOLD PLATING BATH AND PROCESS

BACKGROUND OF THE INVENTION

This invention relates to a bath and process for plating a gold or gold alloy deposit. More particularly, it relates to such a sulfite complex and nitrogen-free diphosphonic compound.

The use of alkali gold sulfite electroplating baths has been disclosed in U.S. Pat. Nos. 3,057,789; 3,475,292; and 3,666,640, the contents of which are incorporated herein by reference. An improvement over the processes described in the foregoing patents is provided by the present invention wherein a nitrogen-free phosphonic compound is added to the plating bath in order to enhance the stability of the bath and improve the brightness and grain refinement of the gold electrodeposit. The use of both nitrogen-containing and nitrogen-free phosphonate compounds has been suggested in gold plating baths where the gold is present in the form of potassium gold cyanide. (See U.S. Pat. No. 3,762,969.)

SUMMARY OF THE INVENTION

It has now been found that nitrogen-free diphosphonic compounds may be advantageously added to gold sulfite electroplating baths. Bath stability is improved and a refinement of the grain size of the electrodeposit is accomplished. Surprisingly, nitrogen containing compounds of the phosphonic type show no such advantages.

DETAILED DESCRIPTION OF THE INVENTION

The electroplating bath of the present invention contains gold in the form of a complex gold-sulfite and a nitrogen-free diphosphonic compound.

As described in the aforementioned patents, the aqueous gold sulfite containing bath is prepared by reacting a water soluble gold salt with a sulfite or bi-sulfite. The cationic portion of the sulfite may be selected from the group consisting of the alkali metals, magnesium, and ammonium. The concentration of gold present in the form of the complex sulfite will normally be between 2 and 82 grams per liter. The lower level concentrations will result in a need for higher current densities or extended plating times whereas higher concentrations will result in excessive drag-out of expensive gold plating salts.

Suitable phosphonate compounds may be selected from the di-phosphonic acids or their derivatives having a nitrogen-free phosphorus to a phosphorus chain. The chemical formula for such compounds is disclosed in U.S. Pat. No. 3,475,293 and is represented by:

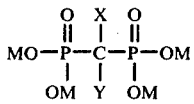

wherein X and Y may be independently selected from the group consisting of H, OH and alkyl groups of 1–4 carbon atoms and wherein each M is independently selected from the group consisting of H, $NH_4$, alkali metal, and a lower alkyl or lower alkylamine of 1–4 carbon atoms. Anhydrides of the diphosphonic acids may also be employed.

Preferred are the ethylidene di-phosphonic acids and most preferred is the particular compound 1-hydroxyethylidene-1, 1-diphosphonic acid. This compound is available commercially under the trademark DEQUEST 2,010 supplied by Monsanto Company. The effective concentration for the phosphonate compound will depend to some extent on the concentration of the gold sulfite and alloying metals in the bath. A concentration of at least 0.1 grams per liter is a typical minimum requirement in order to obtain the advantageous effects of the invention.

The pH of the plating solution may be adjusted with any common bases or acids normally used for such purposes. As taught in U.S. Pat. Nos. 3,475,292 and 3,666,640, such baths must normally be maintained at a pH of at least 8 and preferably 9 to 11 in order to avoid instability of the bath. The pH stability range of the gold-sulfite baths may be extended downward to a value of about 4.5, preferably between 5.0 and 8.0, by the additional presence of ammonia or a polyamine compound. Examples of suitable polyamine compounds are set forth in copending application Ser. No. 229,165, now U.S. Pat. No. 3,787,463, and include piperazine, triethylenediamine, o-phenylenediamine, 1,4-diaminocyclohexane, ethylenediamine, diethylenetriamine, bis-(2-hydroxyethyl)-1,4-piperazine, and the salts of ethylenediamine tetraacetic acid. Thus, where it is desired to maintain a solution pH of below 8.0, it is understood that a sufficient quantity of an ammonia or polyamine compound will be included so as to render the bath stable at the lower pH. Typically, the polyamine may be included in a molar ratio to the gold present of approximately 1:1.

Additional additives which may be included in the bath include complexing agents, alloy producing base metal salts, conducting and buffering salts and brighteners. Most common of the complexing agents are the aminopolycarboxylic acids or their salts as set forth in U.S. Pat. No. 3,666,640.

Base metal salts may be included in the bath for purposes of producing an alloy deposit. For example, soluble salts of cadmium, copper, nickel, cobalt, zinc, manganese, lead, iron, tin, indium, and antimony may be employed. Suitable anionic portions of such salts include, for example, sulfates, chlorides, nitrates, borates, sulfonates, acetates, and oxalates. While the concentration of the alloying element will depend to some extent on the concentration of the gold and other components in the bath, the alloying element concentration will normally be less than 20 grams per liter.

As examples of brighteners, one may include in the bath small quantities of cadmium, thallium, lead, zinc, iron, nickel, cobalt, tin, indium, copper, manganese, vanadium, arsenic, antimony, selenium, or tellurium. As these brighteners are not intended to form any major portion of the deposit, they should be present in very small amounts, e.g., not more than 0.5 grams per liter.

Further suitable additives include the commonly-used conducting and buffering salts. Such salts normally have a cationic portion selected from the group consisting of the alkali metals, the alkaline earth metals, and ammonium and an anionic portion selected from phosphate, sulfate, carbonate, acetate, citrate, tartrate, and sulfite. Of the foregoing soluble salts, the preferred is an alkali metal, magnesium, or ammonium sulfite.

The method of the present invention involves electrolyzing an aqueous solution as herein above-defined employing a base metal as cathode. Best results are obtained employing a current density of 0.1 to 2.0 amps per square decimeter while maintaining the bath between the temperatures of 35° and 60° C.

EXAMPLE 1

An aqueous plating bath was prepared containing the following components:

| | | |
|---|---|---|
| 43.5 | g/l | 1-hydroxyethylidene-1,1 diphosphonic acid |
| 18 | g/l | ethylenediamine |
| 40 | g/l | $Na_2SO_3$ |
| 8.0 | g/l | gold as the sulfite complex |

the pH was adjusted to 7.0 with sulfuric acid and the bath temperature was brought to 50° C. Using a brass panel as cathode, the solution was electrolyzed at a current density of 0.3 amp/dm$^2$ for 10 minutes. The initial deposit was bright and smooth. Two other brass panels were plated for 30 minutes each. These deposits were smooth and semi-bright. Where the same bath was employed, but without the phosphonate, only dull deposits were obtained and the bath decomposed after 30 minutes plating.

EXAMPLE 2

Plating from the bath of Example 1 was continued with the addition of 0.4 g/l cobalt as the sulfate. Plating was continued for 27 hours with periodic addition of cobalt and gold. Deposits obtained varied from bright to semi-bright with most panels qualifying as bright. The Knoop hardness of the deposit varied from 83 to 107. The stability of this bath was greatly enhanced as compared to the same bath without the phosphonate.

COMPARATIVE TESTS 1 and 2

Plating baths were prepared as in Examples 1 and 2 except that nitrogen-containing phosphonates were substituted for the nitrogen-free phosphonate. Amino-tri-(methylene phosphonic acid) was employed in Comparative Test 1 and ethylenediamine tetra (methyl-phosphonic acid) was employed in Comparative Test 2. Neither comparative system was capable of producing bright deposits for any extended period of time. In Comparative Test 1, only semi-bright deposits were obtained and attempts to brighten with cobalt resulted in bath decomposition after only 2 hours. In Comparative Test 2, the bath gave only semi-bright deposits after 10 minutes. Periodic addition of cobalt over the next 3 hours failed to improve the brightness of the deposit.

EXAMPLE 3

A bath was prepared as in Example 1. The ethylene diamine was omitted and the pH was this time adjusted to 8.5. Brass panels were plated without the addition of cobalt as in Example 1 and no decomposition of the bath was noted after 40 minutes. When the nitrogen containing phosphonates of Comparative Tests 1 and 2 were employed, decomposition began after 10 minutes plating time.

What is claimed is:

1. A cyanide-free aqueous electroplating bath comprising 2–82 g/l of gold in the form of a sulfite complex, at least 0.1 g/l of an organic diphosphonic compound having a nitrogen-free phosphorus to phosphorus chain and an ammonium or polyamine compound, said bath having a pH between 5.0 and 8.0.

2. The bath of claim 1 wherein said diphosphonic compound has the formula:

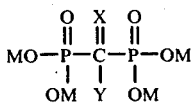

wherein X and Y are independently selected from the group consisting of H, OH and alkyl groups of 1–4 carbon atoms and each M is independently selected from the group consisting of H, $NH_4$, alkali metal and lower alkyl or alkylamine of 1–4 carbon atoms.

3. The bath of claim 2 wherein said diphosphonic acid is 1-hydroxyethylidene-1, 1-diphosphonic acid.

4. A method of obtaining a gold containing deposit on a base metal comprising electrolyzing the solution of claim 1 with said base metal as cathode.

5. The method of claim 4 wherein said solution is maintained between 35° and 60° C and the curent density is between 0.1 and 2.0 amps per square decimeter.

* * * * *